United States Patent [19]

Wickens

[11] 4,162,653

[45] Jul. 31, 1979

[54] RAILWAY VEHICLE BOGIES RESILIENTLY INTERCONNECTED AXLE BOXES

[75] Inventor: Alan H. Wickens, Duffield, England

[73] Assignee: British Railways Board, London, England

[21] Appl. No.: 707,577

[22] Filed: Jul. 22, 1976

[30] Foreign Application Priority Data

Jul. 25, 1975 [GB] United Kingdom ..... 31214/75

[51] Int. Cl.[2] ..... B61F 5/00; B61F 5/30; B61F 5/40; B61F 5/52

[52] U.S. Cl. ..... 105/166; 105/167; 105/168; 105/183

[58] Field of Search ..... 105/165, 167, 182, 166, 105/182 R, 183

[56] References Cited

U.S. PATENT DOCUMENTS

| | | | |
|---|---|---|---|
| 8,560 | 12/1851 | Hinkley | 105/166 |
| 33,167 | 8/1861 | Youmans | 105/167 |
| 245,920 | 8/1881 | Fee | 105/166 |
| 749,947 | 1/1904 | Nordell | 105/166 |
| 986,185 | 5/1911 | Lincoln | 105/165 |
| 1,621,493 | 3/1927 | Charles | 105/166 |
| 1,855,997 | 4/1932 | Shannon | 105/166 |
| 3,528,374 | 9/1970 | Wickens | 105/165 X |

FOREIGN PATENT DOCUMENTS

| | | | |
|---|---|---|---|
| 595469 | 7/1925 | France | 105/166 |

OTHER PUBLICATIONS

Wickens, A. H.; Steering and Dynamic Stability of Railway Vehicles; Vehicle System Dynamics 5 (1975/1976); pp. 15–46.

*Primary Examiner*—Trygve M. Blix
*Assistant Examiner*—Howard Beltran
*Attorney, Agent, or Firm*—Pollock, Vande Sande and Priddy

[57] ABSTRACT

A railway vehicle or a truck thereof having at least three wheelsets, diagonal elastic bracing being provided between each pair of adjacent wheelsets and additional diagonal elastic bracing being provided between non-adjacent wheelsets.

6 Claims, 7 Drawing Figures

RAILWAY VEHICLE BOGIES RESILIENTLY INTERCONNECTED AXLE BOXES

This invention relates to railway vehicles and trucks for railway vehicles and is concerned with the development of the invention described and claimed in my U.S. Pat. No. 3,528,374, issued Sept. 15, 1970 so that it is more advantageously applicable to railway vehicles and trucks having three or more wheelsets.

For a two wheelset vehicle or truck it can be shown that for perfect steering there should be zero bending stiffness between the wheelsets. That is to say the vehicle or truck structure extending between the two wheelsets should offer substantially no restraint to horizontal rotation of the wheelsets from their parallel and aligned positions. However if the bending stiffness is zero, the vehicle lacks dynamic stability since the critical speed of instability is zero. In this case the vehicle or truck undergoes a steering oscillation which occurs at the kinematic frequency of a single wheelset.

This invention described and claimed in my U.S. Pat. No. 3,528,374, the disclosure of which is incorportated herein by reference for a fuller understanding of the present invention, seeks to optimize steering and stability by introducing in a controlled manner the minimum possible bending stiffness.

The invention claimed in my U.S. Pat. No. 3,528,374 is to running gear for a railway vehicle comprising in combination, at least two wheel sets each including a live axle, an axle bearing supporting each end of each said axle, and elastic means for interconnecting at least one axle bearing of one wheelset with at least one axle bearing of the other wheelset, said elastic interconnecting means in response to movement of said wheelsets to non-parallel or non-aligned positions producing restoring forces to restore said wheelsets to their parallel and aligned positions.

Various combinations of elastic interconnecting means are described in my aforesaid U.S. Patent and in particular a combination of diagonal and longitudinal elastic interconnecting means between each axle bearing of one wheelset and both axle bearings of the outer wheelset.

In my aforesaid U.S. Patent it is stated that if the vehicle or truck has more than two wheelsets, the elastic interconnecting means is provided between each adjacent pair of wheelsets.

In accordance with the present invention the steering and stability for a vehicle or bogie having three or more wheelsets is improved by additionally providing elastic interconnecting means between at least one pair of non-adjacent wheelsets. The term "non-adjacent" wheelsets, as used herein and in the appended claims, means a pair of wheelsets which are spaced from one another by at least one additional wheelset that is interposed between said pair of wheelsets.

The mechanical implementation of the elastic interconnecting means between a pair or pairs of non-adjacent wheelsets can be as described in my aforesaid U.S. Patent. Thus it may take the form of a strut with resilient material forming part of the length of the strut, a fluid spring or an arrangement incorporating a torque tube.

The construction and operation of the present invention will become more readily apparent from the following description and accompanying drawings, wherein.

Figure 1:
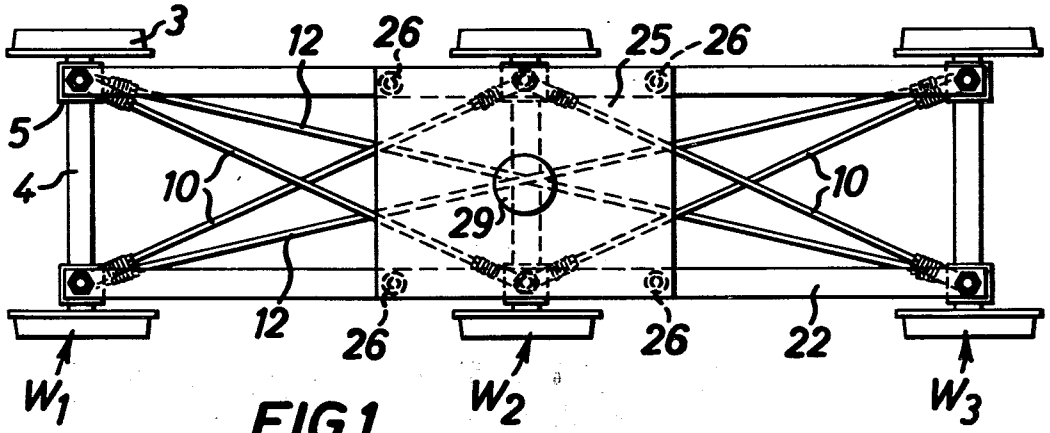
FIG. 1 is a diagrammatic illustration of a three wheelset truck incorporating the present invention.
Figure 4:
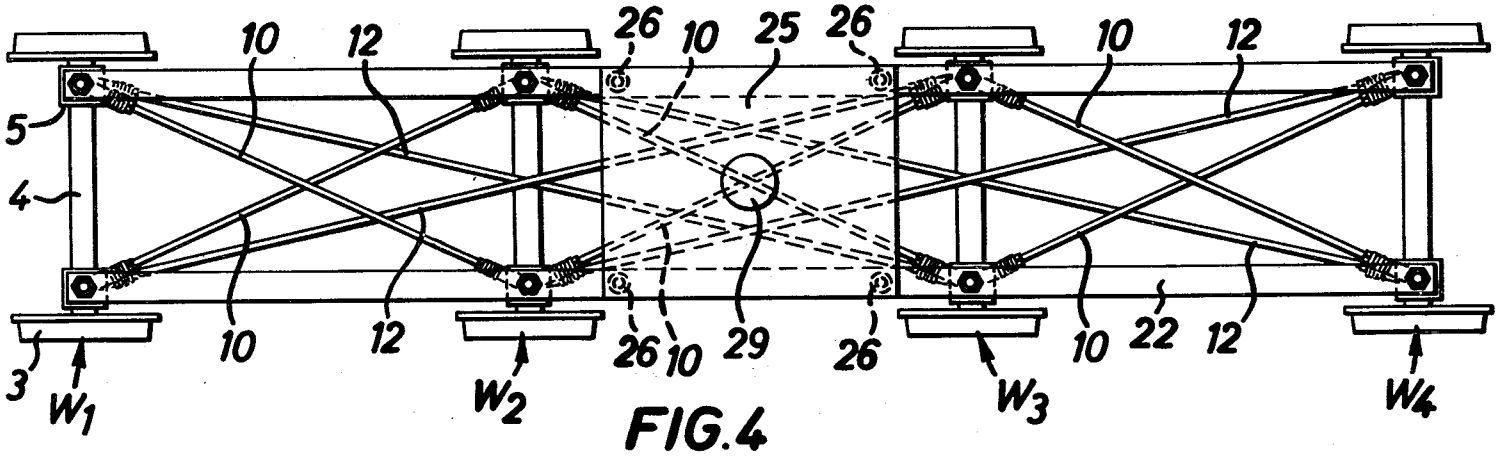
FIG. 4 is a diagrammatic illustration of a four wheelset truck incorporating the present invention.
Figure 6:
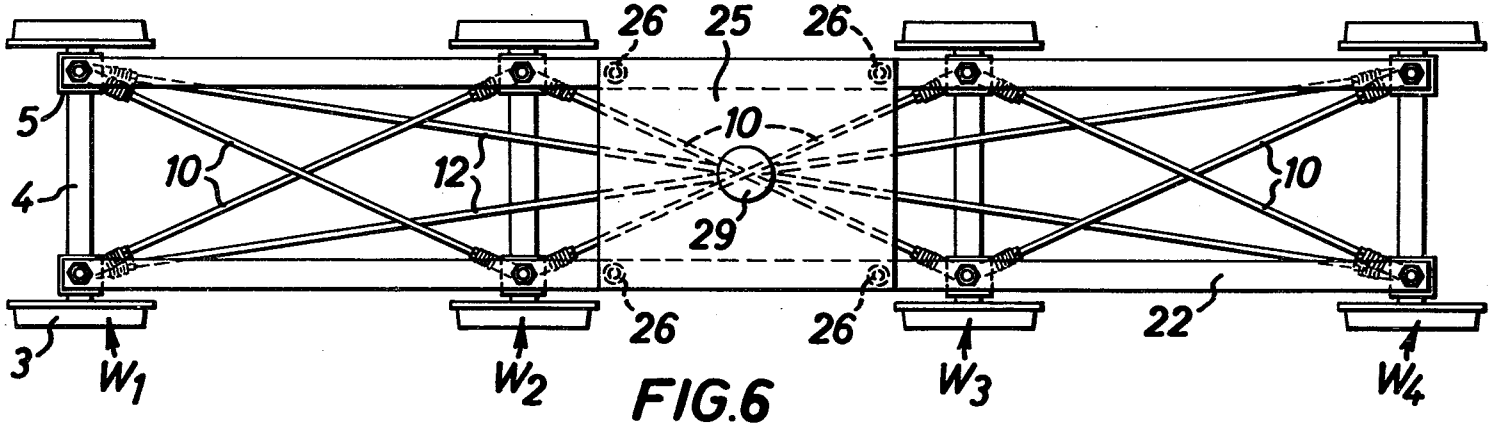
FIG. 6 is a diagrammatic illustration of a four wheelset truck incorporating a different embodiment of the present invention.

In each of FIGS. 1, 4 and 6 the diagonal elastic interconnecting means, constructed in accordance with the principles set out in U.S. Pat. No. 3,528,374, is shown at 10. Thus, in the case of FIG. 1 elastic means 10 are interconnected between the axle bearings of wheelsets $W_1$ and $W_2$ and between the axle bearings of wheelsets $W_2$ and $W_3$, respectively, and in the case of FIGS. 4 and 6 elastic means are interconnected between the axle bearings of wheelsets $W_1$ and $W_2$, the axle bearings of wheelsets $W_2$ and $W_3$, and the axle bearings of wheelsets $W_3$ and $W_4$.

The additional diagonal elastic interconnecting means provided between the axle bearings of non-adjacent wheelsets, in accordance with the present invention, is shown at 12. Thus in the case of FIG. 1, the additional elastic means 12 are provided between the axle bearings of wheelsets $W_1$ and $W_3$; in the case of FIG. 4, the additional elastic means 12 are provided between the axle bearings of wheelsets $W_1$ and $W_3$ and of wheelsets $W_2$ and $W_4$; and in the case of FIG. 6, the additional elastic means 12 are provided between the axle bearings of the two end wheelsets $W_1$ and $W_4$.

In the exemplified trucks of FIGS. 1, 4 and 6, the wheelsets $W_1$, $W_2$, $W_3$, and $W_4$ comprise wheels 3 mounted on live axles 4, that is to say axles which are solidly connected to the wheels 3. The axles 4 rotate in axle bearings 5.

Figure 3:
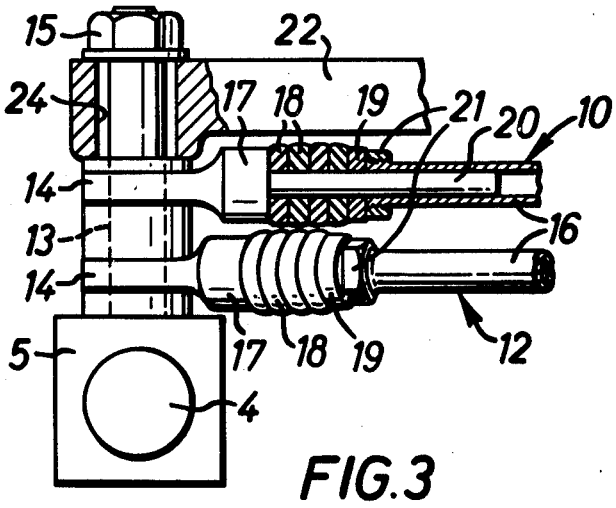
FIG. 3 shows to a larger scale than FIG. 1 the connections of the elastic bracing members at one of the axle bearings.

The diagonal elastic interconnecting means comprise elastic bracing struts 10, 12. At their ends, the bracing struts 10 and 12 are connected to the axle bearings 5. The common connection for one of the bracing struts 10 and for one of the bracing struts 12 is shown in FIG. 3. A bolt 13 extends vertically from the axle bearing 5 and an eye is provided in the flattened ends 14 of the struts 10 and 12 through which the bolt 13 passes to pivotally mount the struts 10 and 12. The ends of the struts 10 and 12 are retained on bolt 13 by a lock nut 15.

To provide the desired elastic characteristics, the bracing struts 10 and 12, as shown in FIG. 3 for one of the struts 10, comprise a central tubular strut portion 16 having an end fitting 17 at each end thereof. Between each end fitting 17 and the central portion 16 are interposed a series of rubber washers 18 which give the required elasticity to the members 10 and 12. At one end, the series of washers 18 abuts against a face of the end fitting 17 and at the other end abuts against a thrust washer 19 which in turn abuts against a nut 21 threadedly engaging the central tubular portion 16. To locate the washers 18 and thrust washer 19, the end fitting 17 has a spindle 20 extending into the central tubular portion 16 on which the washers 18 and 19 are supported.

After fitting of the bracing struts, the rubber washers 18 are prestressed by adjustment of nut 21.

Lightweight side frames 22 extend longitudinally of the trucks and are connected at their ends to the axle bearings 5. The mounting of the side frames 22 on the axle bearings is such that the side frames 22 are only required to support vertical loading, that is to say they do not become stressed longitudinally by displacement of one of the axles relative to the other. Such a mounting of the side frames could be effected in several ways as will be appreciated by persons skilled in the art. Thus, the side frames 22 could be mounted on the pivot bolts 13, as shown in FIG. 3, the pivot bolts 13 passing into longitudinal slots 24 in the side frames 22.

Figure 2:
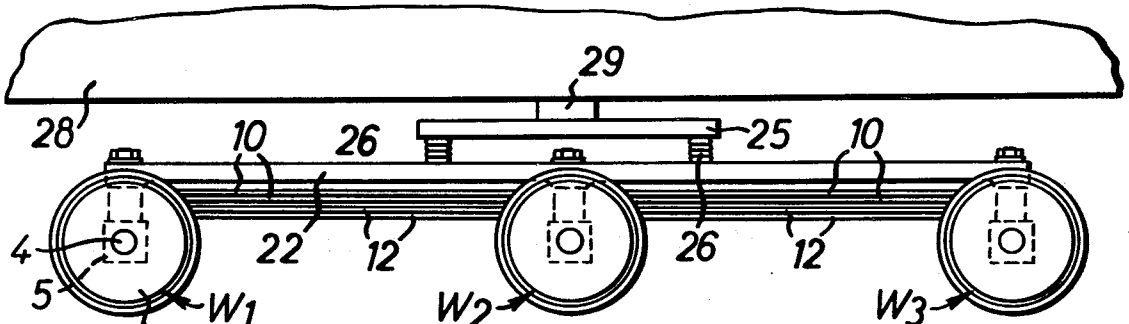
FIG. 2 shows in side elevation the mounting of a vehicle body on the truck of FIG. 1.
Figure 5:
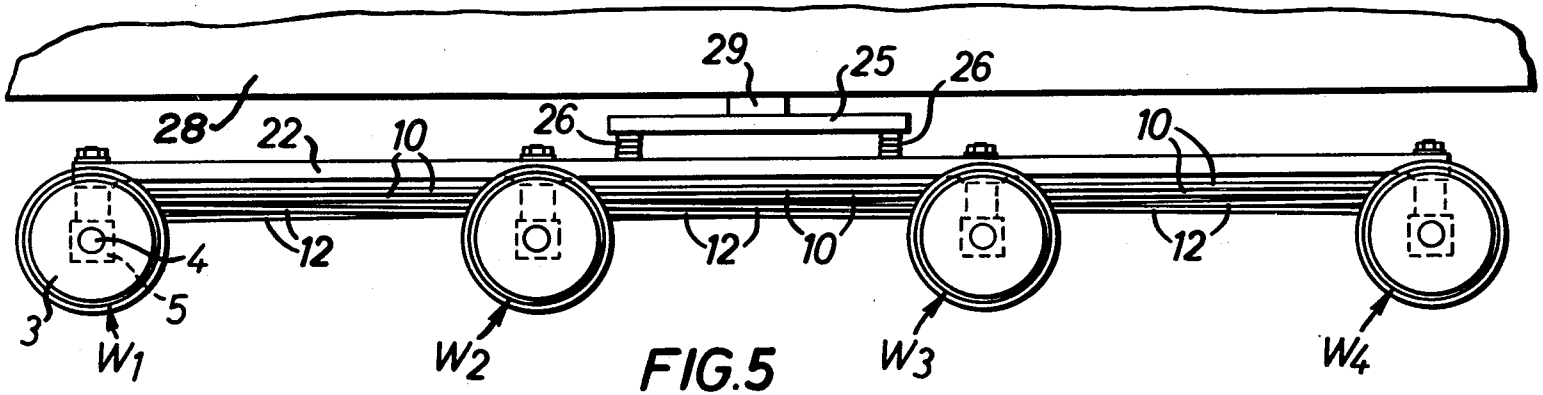
FIG. 5 shows in side elevation the mounting of a vehicle body on the truck of FIG. 4.
Figure 7:
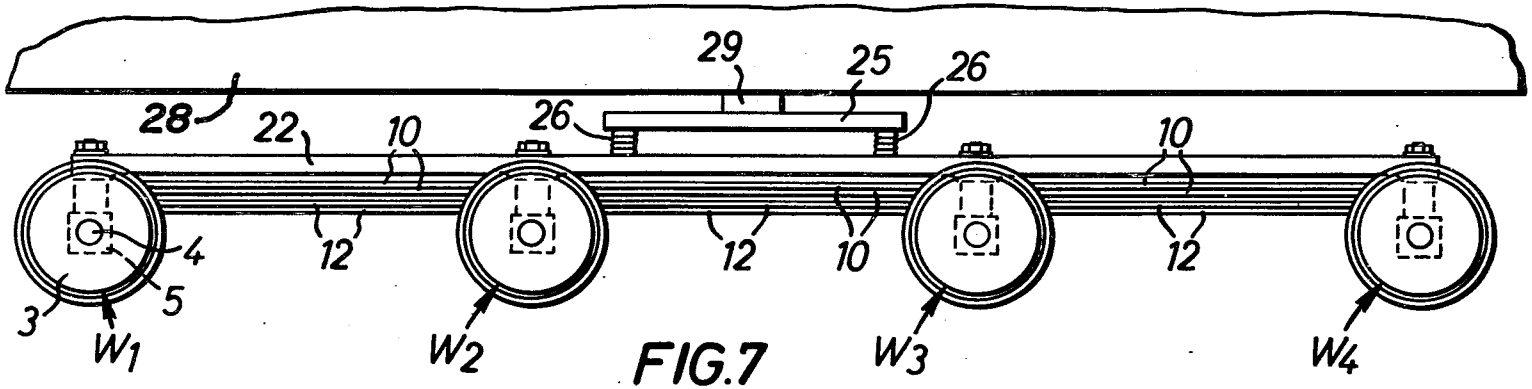
FIG. 7 shows in side elevation the mounting of a vehicle body on the truck of FIG. 6.

Extending between the side frames 22 to form a truck body in each of the exemplified constructions of FIGS. 1, 4, and 6, is a bolster 25 which, referrinng also to FIGS. 2, 5, and 7, is mounted on the side frames 22 through conventional vertical springing 26. The vehicle body 28 (FIGS. 2, 5, and 7) in each of the exemplified constructions is mounted at one end of the track in conventional manner through a vertical pivot 29 on the bolster 25. A similar truck will also be provided at the other end of the vehicle body.

I claim:

1. In a railway vehicle, running gear for said vehicle comprising in combination, at least three wheelsets each including a live axle, an axle bearing supporting each said axle, elastic means for interconnecting at least one axle bearing of each wheelset with at least one axle bearing of each adjacent wheelset, said elastic interconnecting means being operative in response to movement of said wheelsets away from their parallel and aligned positions to produce restoring forces to restore said wheelsets to their parallel and aligned positions, and additional elastic means extending continuously between and interconnecting at least one axle bearing of one wheelset with the diagonally opposite axle bearing of a non-adjacent wheelset.

2. The running gear of claim 1, wherein said additional elastic interconnecting means extends from each axle bearing of said one wheelset to the diagonally opposite axle bearing of said non-adjacent wheelset.

3. The running gear of claim 1 and comprising four wheelsets, wherein said additional elastic interconnecting means extends between axle bearings of two pairs of non-adjacent wheelsets.

4. The running gear of claim 3, wherein said additional elastic inerconnecting means extends from each axle bearing of one wheelset of each pair of non-adjacent wheelsets to the diagonally opposite axle bearing of the other wheelset of the pair.

5. The running gear of claim 1 and comprising four wheelsets, wherein said additional elastic interconnecting means extends between the axle bearings of the end wheelsets.

6. The running gear of claim 5, wherein said additional elastic enterconnecting means extends between each axle bearing of one end wheelset and the diagonally opposite axle bearing of the other end wheelset.

* * * * *